United States Patent [19]

Genuit et al.

[11] Patent Number: 4,506,256

[45] Date of Patent: Mar. 19, 1985

[54] ANNUNCIATOR CONTROL CIRCUIT

[75] Inventors: Luther L. Genuit, Scottsdale; John R. Nowell, Phoenix, both of Ariz.

[73] Assignee: Honeywell Information Systems Inc., Phoenix, Ariz.

[21] Appl. No.: 366,128

[22] Filed: Apr. 7, 1982

[51] Int. Cl.[3] ..... G08B 26/00

[52] U.S. Cl. ..... 340/518; 340/524; 340/525; 340/653; 340/825.1; 340/825.17

[58] Field of Search ..... 340/518, 506, 521, 524, 340/525, 653, 652, 651, 657, 825.1, 825.06, 825.11, 825.13, 825.17

[56] References Cited

U.S. PATENT DOCUMENTS

| | | | |
|---|---|---|---|
| 3,665,399 | 5/1972 | Zehr et al. | 340/518 |
| 3,940,739 | 2/1976 | Quimet | 340/518 |
| 3,964,302 | 6/1976 | Gordon et al. | 340/518 |

*Primary Examiner*—Donnie L. Crosland
*Attorney, Agent, or Firm*—A. A. Sapelli; L. J. Marhoefer; J. S. Solakian

[57] ABSTRACT

An annunciator arrangement includes a segmented display unit with segments which may be selectively activated. There is also provided scanning means for scanning a fault line from each of a number of computer components such as voltage regulators to determine the presence or absence of a fault signal thereon. Logic circuitry is provided for selectively displaying on the segmented display units a numerical indication representative of the particular fault line upon which a fault signal has been detected. Such annunciator display is provided at the control panel of the computer rendering it unnecessary for the operator thereof to access the inward parts of the computer in order to determine which component of the computer is indicated as failing.

10 Claims, 3 Drawing Figures

ANNUNCIATOR CONTROL CIRCUIT

BACKGROUND OF THE INVENTION

The present invention relates to computer apparatus. More particularly, it relates to a control circuit for annunciator means for use with a computer apparatus or system.

In a computer system there are a large number of individual components the proper functioning of which is essential to the reliable operation of the computer, itself. Typically, many of the computer components rely on a relatively stable selection of voltage levels. To this end, a number of voltage regulated power supply units are incorporated into the component system. When such regulators fail, the operating units of the computer system dependent thereon must also fail. Inasmuch as each system includes a number of such regulators, it is important for a service person to be able to determine which of the regulators has, in fact, failed. To this end, there have been provided in the past, detector circuits connected to a light emitting diode or other small illuminating unit positioned adjacent the regulator to identify such a failure. Since such regulators with their indicating lamps are traditionally located deep within the inward parts of the computer structure, in order for an operator to identify the failed regulator before calling for a service person to come to make the necessary repairs, it is necessary for the operator to gain access to such inward parts of the computer in order to make the determination. It is highly desirable to have a proper identification made to the service person before he makes his trip to the site of the computer in order that he may bring with him the necessary replacement parts. Since most operators of the computer are not skilled technicians on the working parts of the computer, it is desirable to not give them access to the inner working parts thereof.

SUMMARY OF THE INVENTION

It is, accordingly, an object of the present invention to provide an improved annunciator means for status indication of a computer component.

It is another object of the present invention to provide an improved annunciator as set forth which obviates the aforementioned shortcomings.

It is a further object of the present invention to provide an improved annunciator arrangement as set forth which does not require the operator of the computer to have access to the inward parts of the computer.

In accomplishing these and other objects, there has been provided, in accordance with the present invention, an annunciator arrangement which includes a segmented display unit with segments which may be selectively activated. There is also provided scanning means for scanning a fault line from each of a number of computer components such as voltage regulators to determine the presence or absence of a fault signal thereon. Logic circuitry is provided for selectively displaying on the segmented display units a numerical indication representative of the particular fault line upon which a fault signal has been detected. Such annunciator display is provided at the control panel of the computer rendering it unnecessary for the operator thereof to access the inward parts of the computer in order to determine which component of the computer is indicated as failing.

BRIEF DESCRIPTION OF THE DRAWINGS

A better understanding of the present invention may be had from the following detailed description when read in the light of the accompanying drawings in which.

DETAILED DESCRIPTION

Figure 1A:
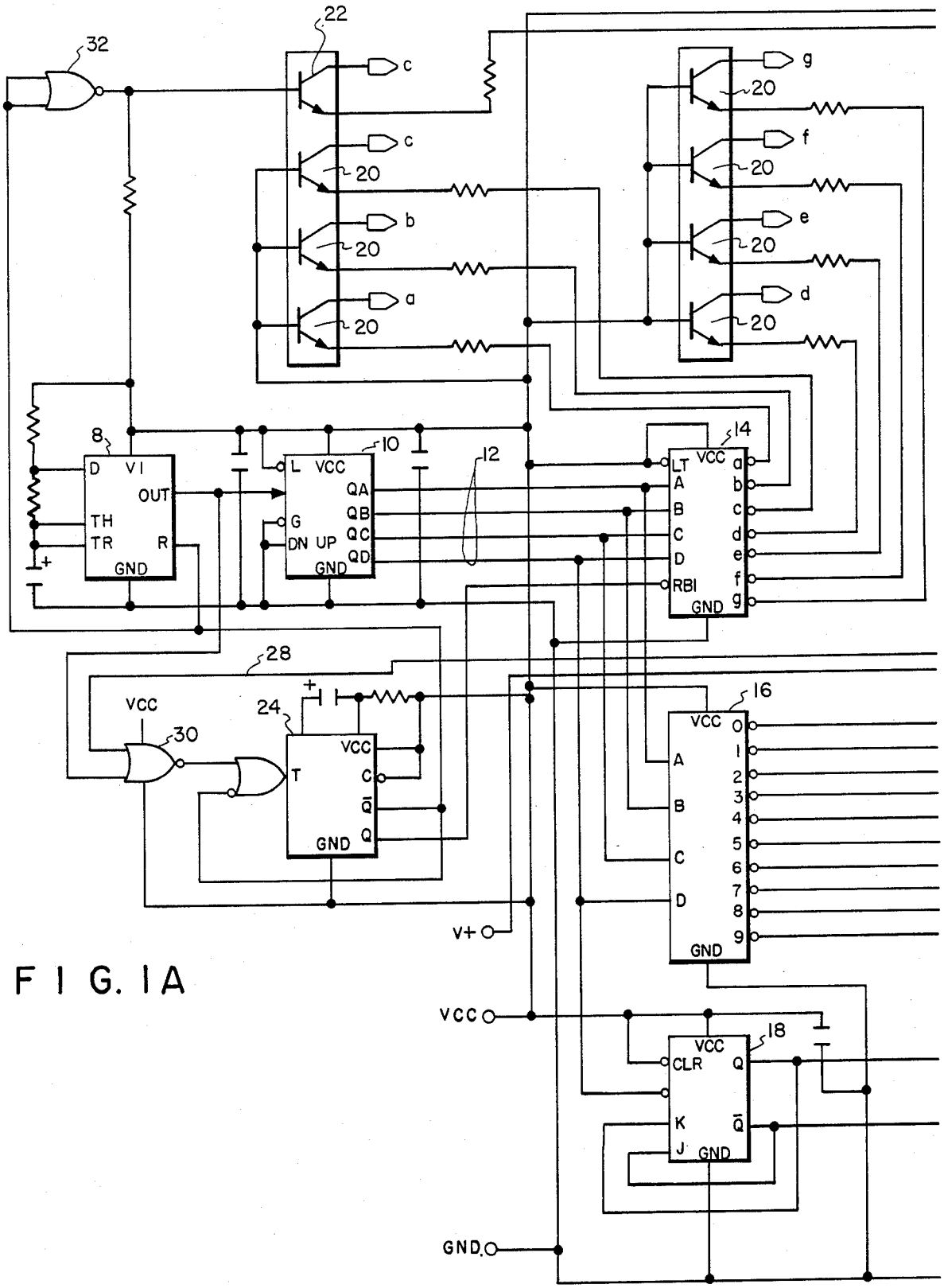
FIGS. 1A and 1B comprise a logic block diagram of a control circuit in accordance with the present invention.
Figure 1B:
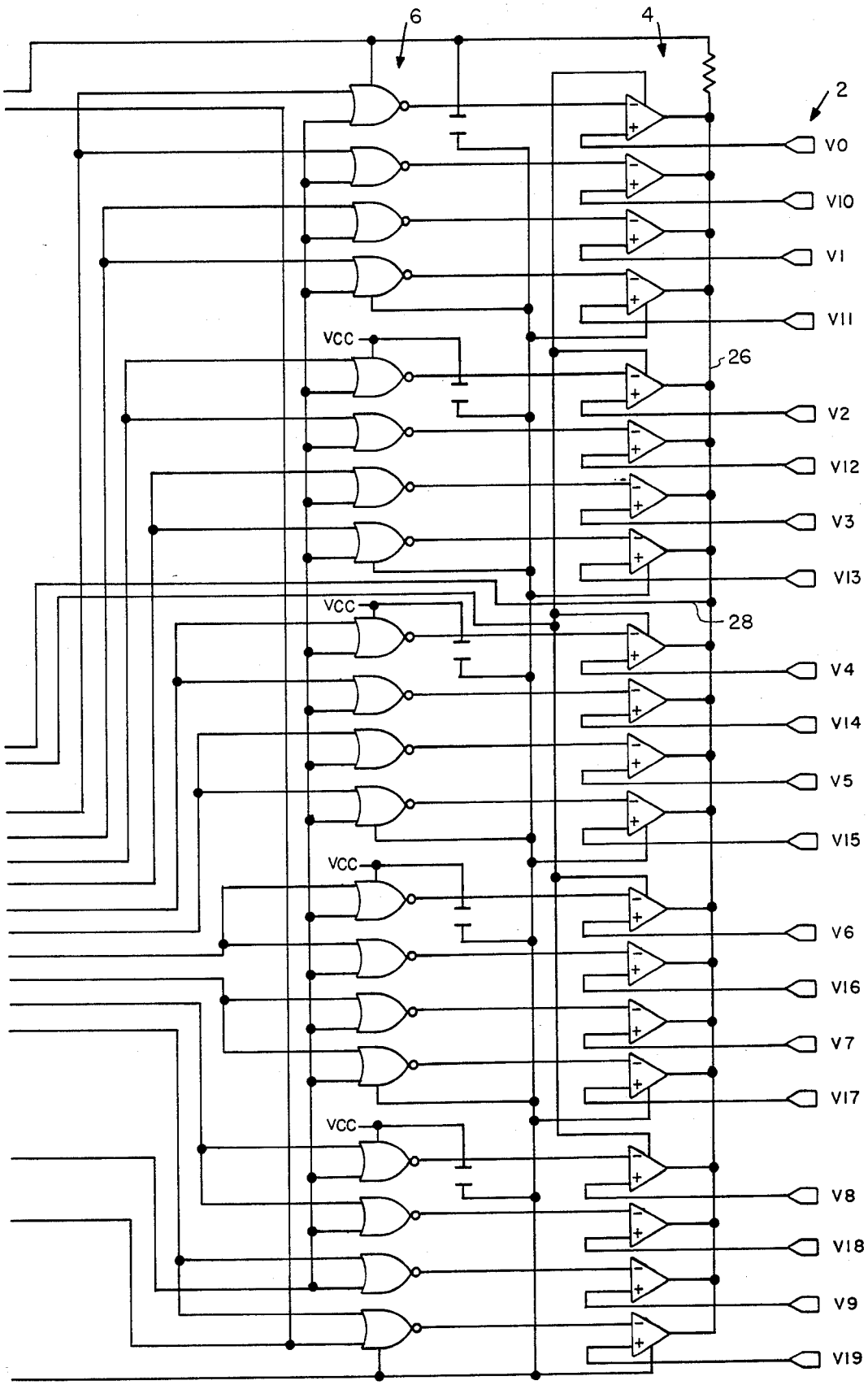

Referring now to the drawings in more detail, there is shown in FIG. 1 a schematic logic diagram of an exemplary annunciator control circuit constructed in accordance with the present invention. From a plurality of circuit components such as voltage regulator circuits, there are a like plurality of fault signal input lines 2. In the exemplary embodiment, twenty such input lines 2 are shown and are individually identified as representing input signals VØ through V19. There is also provided a like plurality of comparators 4. Each of the input signal lines is connected to one input terminal of the corresponding one of the comparators 4. Again, a like plurality of NOR gates are provided the outputs of which are connected, respectively, to the second input terminal of the corresponding ones of the comparators 4. In the exemplary embodiment of the control circuit in accordance with the present invention, the NOR gates were in the form of integrated circuit modules identified, for example, as 74LS02, in which four NOR gates are included in each module. Accordingly, there are five such modules. Similarly, the comparators, in the exemplary embodiment were in the form of integrated circuit modules again wherein four comparators are included in each module, there being five such modules. These modules, may, typically, be of the commercially available type identified as LM339.

Timing and control circuitry for the scanning of the several input circuits is provided. Basic timing for the circuit is provided by an oscillator 8 which, in the exemplary embodiment, is an integrated circuit module identified as LM555 connected as a free-running multivibrator. The output of the multivibrator 8 is, in the exemplary embodiment, a square wave having a period of approximately 12 ms. The output terminal of the multivibrator 8 is connected to the clock input terminal of a counter 10. The counter 10 in the exemplary embodiment is a decade counter in the form of an integrated circuit module commercially available as a 74LS190. The output signal from the counter 10 appears as a four bit binary code on the four output lines 12 connected to the four output terminals Q A, Q B, Q C and Q D of the counter 10. In the preferred embodiment, the counter 10 counts the input clock signals from the multivibrator 8 counting up to 10 then returning to zero and counting to 10 again and repetitively.

The output lines 12 are connected, first, as input signals to a binary to seven-segment decode driver unit 14. In the preferred embodiment, that decoder unit is in the form of integrated circuit module identified as a 7446. More will be said of that unit hereinafter. The four output lines 12 are also connected as input lines to a one-out-of-ten decoder 16. Again in the preferred embodiment, the one-out-of-ten decoder is in the form of an integrated circuit module identified as a 7442. The decoder 16 has four input terminals connected respectively to the lines 12. The module 16 also has ten output terminals labeled Ø through 9. The consecutive ones of the output terminals of the decoder 16 are connected to a first input terminal of each of consecutive pairs of the NOR gates 6. More specifically, the Ø output terminal of the decoder 16 is connected to one input terminal of each of the two NOR gates 6 associated with the VØ and V1Ø fault line input terminals 2. The 1 output terminal of the decoder 16 is connected to one input terminal of each of the two NOR gates 6 respectively associated with the V1 and V11 fault line input terminals 2. The successive progression continues to the point where the number 9 output terminal of the decoder 16 is connected to one input terminal of each of the NOR gates 6 associated respectively with the V9 and the V19 fault line input terminals 2. Thus as each of the output terminals of the decoder 16 is successively selected, the successive pairs of the NOR gates 6 are accordingly enabled.

It will be noted that the most significant bit signal of the four lines 12, the lower most line of the illustration shown in FIG. 1, is also connected to the clock input of a flip-flop 18. The flip-flop 18 is connected as a divide-by-two circuit and, in the exemplary embodiment comprises an integrated circuit module identified as a 7473. The flip-flop 18 changes state each time the signal applied to the clock input terminal thereof changes from a high condition to a low condition. Thus each time the counter 10 reaches a count of 10, the flip-flop 18 will change its output status. The Q output terminal of the flip-flop 18 is connected to the second input terminal of alternate ones of the NOR gates 6. More specifically the Q output terminal is connected to the second input terminal of the NOR gates 6 associated with the fault input signal line VØ, V1, V2, V3, etc. through V9. Similarly, the $\overline{Q}$ output terminal is connected to the second input terminal of the intervening NOR gates 6. More specifically the $\overline{Q}$ output terminal of the flip-flop 18 is connected to the second input terminal of those NOR gates associated with the fault signal lines V1Ø, V11, V12, V13 through V19. Thus, on one count of ten from the counter 1Ø the NOR gates 6 associated with the input terminals VØ, V1, etc. will be successively scanned. On the second count of 10, the NOR gates 6 associated with the input lines V10, 11, and 12, etc. will be successively scanned.

The decoder 14 was defined as being a binary to seven-segment decoder. Specifically, the decoder 14 accepts the binary signals applied to the input terminals thereof from the lines 12 and converts that into a corresponding arrangement of output signal on the seven output terminals thereof which, when applied to control the several segments of a seven-segment numerical display unit, will produce an indication on the seven-segment display representative of the binary number applied to the input terminals thereof. In accordance with the preferred embodiment, the output signals from the decoder 14 are applied respectively to enable 7 corresponding current source transistors 20. The several output terminals of the decoder 14 are connected, respectively, to the emitter electrodes of the corresponding ones of the seven transistors 20. The collector electrode of each of these transistors is connected to a corresponding segment of a least significant digit seven-segment display unit. More will be said of the seven-segment display unit hereinafter. An eighth transistor 22 has its emitter connected to the $\overline{Q}$ output of the flip-flop 18. The collector of the transistor 22 is connected to energize two segments of the most significant digit seven-segment display units to represent a numeral 1 whenever properly energized by the operation of the flip-flop 18.

A monostable multivibrator or one-shot 24 is provided. The Q output terminal of the one-shot 24 is connected to a blanking input of the decoder driver 14. So long as the one-shot 24 remains in its reset or stable condition, the output of the decoder 14 will be blanked. Thus, even though the decoding of the successive signals appearing on the input lines 12 are continuous, there will be no outputs and consequently no excitation of the seven-segment indicators so long as the one-shot 24 is in its stable condition.

The output terminals of all of the comparators 4 are connected together to a bus 26. That bus is connected by a lead 28 to one input terminal of a NOR gate 30 the other input terminal of which is connected to the output terminal of the timer/multivibrator 8. The output of the NOR gate 30 is connected to the high trigger input terminal of the one-shot 24. The $\overline{Q}$ output terminal of the one-shot 24 is connected to the low trigger inputs thereof, to prevent retriggering during the cycle of the one-shot. The $\overline{Q}$ output is also connected to the reset input terminal of the timer multivibrator 8 as well as to the input of an inverter 32. The output of the inverter 32 is connected to the base electrode of the transistor 22.

Figure 2:
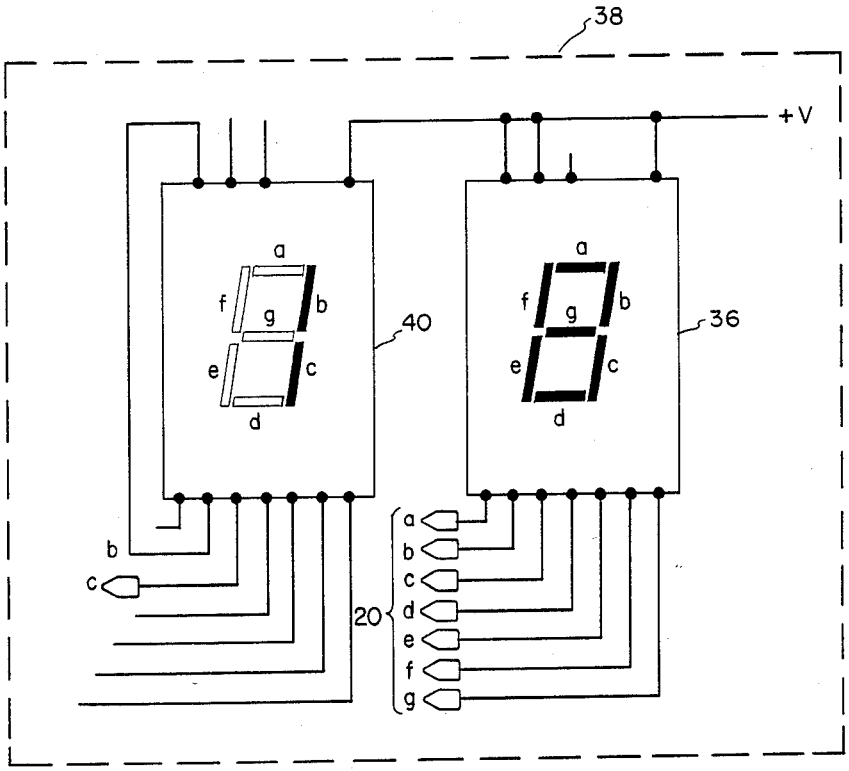
FIG. 2 is a block diagram of an annunciator display in accordance with the present invention.

As noted the collectors of the transistors 20 are connected to the input terminals respectively of a seven-segment display unit. The collector terminals in FIG. 1 have been designated with the letters a, b, c, d, e, f and g. These correspond to the similar input terminals of a least significant digit seven-segment display unit 36 shown in FIG. 2. The letter designation of the leads corresponds to the letter designation of the particular segment of the display unit which is to be controlled by the excitation of the respective input leads. In the illustrative embodiment of the present invention, the display 38 is preferrably a two-digit display with the display unit 36 being the least significant digit. A most significant digit display unit 40 is connected to be energized from the transistor 22 of FIG. 1. Thus, the collector of the transistor 22 is connected to the C input terminal of the most significant digit display unit 40. That segment is connected in series with the B input terminal of the same display units to effectively indicate a numeral one, as shown from the single input lead from the transistor 22. As noted the emitter of the transistor 22 is connected to the $\overline{Q}$ output of the flip-flop 18 and is only enabled when the $\overline{Q}$ output of the flip-flop 18 is at a logical low. This, of course, corresponds with the scan of the NOR gates 6 which effectively selects the input fault lines V10 through V19.

In operation, the multivibrator-timer 8, in the absence of a fault signal, generates a continuous stream of square wave pulses with a 12 ms period (in the illustrative embodiment). Those pulses are applied as clock input to the counter 10 which produces the binary code for counts from Ø-9 repeatedly on the lines 12. Those signals are applied as input signals to the seven-segment decoder 14 which continuously generates the successive code output signals representative of the succession of one digit numerals from 0–9. In the absence of a fault indication, however, the output terminals of the decoder 14 are blanked preventing the application of any excitation signals to the seven-segment display unit.

During the second count to ten or scan of the NOR gate 6, the flip-flop 18 will have been set, making the $\overline{Q}$ output at a logical low. That logical low is applied to the emitter of the transistor 22, effectively enabling that transistor to energize the most significant digit display units in the indicator to exhibit a numeral 1. The transistor 22 is, however, in the absence of a detected fault signal, also blocked. In the absence of such a fault signal the one-shot 24 is in its stable condition with a logical high at the output of the $\overline{Q}$ terminal. That logical high as applied to the input of the inverter 32 the output of which is connected to the base of the transistor 22, disabling that transistor.

In the absence of a fault signal on any of the input lines 2, the voltage level at the non-inverting input terminal of each of the comparators 4 is typically 24 volts. When a fault occurs the signal appearing on the associated line 2 will drop to a value of, typically, 1.5 volts at the non-inverting input of the comparator 4. In the unselected state the output of each of the NOR gates 26 is typically 0.5 volts. That signal is applied to the inverting input terminal of the associated ones of the comparators 4. In the selected state, the output of the selected one of the NOR gates 6 will be on the order of 5 volts.

With no fault appearing on any of the input lines 2, the 24 volt signal will appear at the non-inverting input of all of the comparators 4. Thus whether the output of the NOR gates is selected or unselected, the output of the comparators remains high. When a fault is detected and the appropriate 1.5 volt signal appears on one of the input leads 2, that 1.5 volt signal is still larger than the 0.5 volt signal on the output of an unselected NOR gate 6 accordingly the output of the comparator remains high until that particular associated NOR gate is selected by the scanning effected by the decoder 16. When such coincidence of a scanned NOR gate and a fault signal on the input lead 2 occurs the output of the comparator 4 will change state to a logical low. That logical low will be applied through the lead 28 to the input of the NOR gate 30. That logical low at the input of the NOR gate 30 coincident with a falling pulse from the output of the timing multivibrator 8 triggers the one-shot 24 to change state for a predetermined time interval which, in the exemplary embodiment, was established at 1.3 seconds. The change in state of the output of the one-shot 24 accomplishes several things substantially simultaneously. First it removes the blanking signal from the output of the seven-segment decoder 14 allowing the then extant numerical indication to be displayed on the least significant digit display 36 of the indicator 38. Also the timer multivibrator 8 is stopped by the application of the signal to the reset input thereof. This allows the numerical indication to be displayed for the established period of the one-shot. Again simultaneously the output $\overline{Q}$ signal applied to the input of the inverter 32 allows the output of that inverter 32 to go to a logical high thereby enabling the transistor 22. If the flip-flop 18 is, at that time, in a set condition, the logical low at the $\overline{Q}$ output will then cause the transistor 22 to effect the energization of the most significant digit display unit to display a numeral 1.

When the one-shot 24 has completed its cycle, the output changes state back to its stable condition thereby blanking the output of the decoder 14 and allowing the timer multivibrator to resume producing pulses. At the same time the transistor 22 is disabled by the logical low applied to the base electrode thereof from the inverter 32. With the resumption of pulses from the timer multivibrator 8, the counter 10 resumes the count at the point at which it had been interrupted. Therefor, the decoder 16 picks up the scanning of the NOR gates 6 from the next successive gate after the one that had been previously enabled. If in the continuing of that scanning process another fault line carries the indication of a signal fault then the process will be repeated and the count stopped for the period of 1.3 seconds to allow the numerical identification of that fault line to be displayed.

Thus there has been provided, in accordance with the present invention, an improved annunciator which enables an operator of a computational apparatus to identify a component which has faulted without having to have access to the inner portions of the apparatus.

The embodiments of the invention in which an exclusive property or privilege is claimed are defined as follows:

1. An annunciator for indicating the status of a plurality of components of a system, said annunciator comprising:

indicator means of the type capable of displaying numerical digits in accordance with the energization thereof;

a plurality of component status signal lines connected, respectively, to report the status of said components;

a control circuit coupled to control the selective energization of said indicator means in response to certain status signals applied to said signal lines;

said control circuit including timing means and scanning means controlled by said timing means for sequentially scanning said status signal lines to detect the presence of said certain status signals thereon; and said control circuit further including means responsive to the detection of said certain status signal to energize said indicator means to display a number representative of the component from which said certain status signal was derived on said status signal line.

2. An annunciator as set forth in claim 1 wherein said system comprises a computer system having an operator's station and wherein said indicator means is located.

3. An annunciator as set forth in claim 2 wherein said components represent component parts of said computer system, and wherein said certain status signals occurring on one or more of said status signal lines represent a fault condition at the associated component.

4. An annunicator as set forth in claim 3 wherein said timing means comprises a free-running multivibrator the output of which is connected to drive a counter.

5. An annunciator as set forth in claim 4 wherein said scanning means includes a scanning decoder connected to be driven by the output of said counter, said decoder having a plurality of output terminals which are individually and sequentially activated, and coupling means connected between said output terminals and said status signal lines to sequentially select said status signal lines.

6. An annunciator as set forth in claim 5 wherein said circuit includes display decoder coupled between the output of said counter and said indicator means to selectively energize said display means in accordance with said output of said counter.

7. An annunciator as set forth in claim 5 wherein said coupling means includes gating means sequentially enabled by said scanning decoder.

8. An annunciator as set forth in claim 7 wherein said coupling means further includes comparator means connected to compare the output of said gating means and said certain status signals, respectively.

9. An annunciator as set forth in claim 6 wherein said coupling means includes gating means sequentially enabled by said scanning decoder, and comparator means connected to compare the output of said gating means and said certain status signals, respectively.

10. An annunciator as set forth in claim 9 wherein said comparator means have a common output and wherein said means responsive to the detection of said certain signals includes a monostable multivibrator having a predetermined triggered cycle time and having a triggering input terminal operatively coupled to said common output, and having output circuit means connected to selectively blank output signals from said display decoder during untriggered intervals and to interrupt the operation of said free-running multivibrator during triggered intervals.

* * * * *